US005139433A

United States Patent [19]

Bohaty

[11] Patent Number: 5,139,433

[45] Date of Patent: Aug. 18, 1992

[54] SPECIAL CONNECTOR MEMBERS FOR SMALL ELECTRICAL LIGHT EMITTING DEVICES, BASES, AND SOCKETS

[76] Inventor: Bruce Bohaty, 2347 Ocean Ave., Venice, Calif. 90291

[21] Appl. No.: 685,821

[22] Filed: Apr. 16, 1991

[51] Int. Cl.[5] ..... H01R 4/24

[52] U.S. Cl. ..... 439/395; 439/611

[58] Field of Search ..... 439/611-619, 439/699, 419, 425, 417, 414, 395, 404, 505; 313/318, 351, 49, 51, 317, 318; 362/249, 806, 236-238

[56] References Cited

U.S. PATENT DOCUMENTS

| | | | |
|---|---|---|---|
| 2,786,131 | 3/1957 | Zador | 439/611 |
| 2,884,555 | 4/1959 | Peterson | 459/617 |
| 2,965,875 | 12/1960 | Danesi | 439/419 |
| 3,012,219 | 12/1961 | Levin et al. . | |
| 3,869,190 | 3/1975 | Bazille, Jr. . | |
| 4,264,117 | 4/1981 | Pritulsky | 439/419 |
| 4,291,935 | 9/1981 | Badoz et al. . | |
| 4,504,763 | 3/1985 | Nakanishi et al. | 439/611 |
| 4,682,835 | 7/1987 | Aujla et al. . | |
| 4,722,699 | 2/1988 | Heng et al. . | |
| 4,806,120 | 2/1989 | Baker . | |
| 4,807,098 | 2/1989 | Ahroni | 439/419 |

FOREIGN PATENT DOCUMENTS

| | | | |
|---|---|---|---|
| 251736 | 1/1988 | European Pat. Off. . | |
| 0853183 | 10/1952 | Fed. Rep. of Germany | 439/419 |
| 3637929 | 1/1988 | Fed. Rep. of Germany . | |

*Primary Examiner*—David L. Pirlot
*Attorney, Agent, or Firm*—Thomas I. Rozsa

[57] ABSTRACT

The present invention is for a small electrical light emitting device or socket to have two special electrical connector members. Each of the two special connector members is made of a generally rectangular shaped small and thin conducting plate having a narrow slit defined by two sharp inner edges of the plate. When a portion of an electrical wire having a conducting core and insulating cover is inserted into the narrow slit, the two sharp inner edges of the conducting plate will automatically strip off the insulating cover of the wire immediately adjacent to the slit and thus contact the conducting core of the wire to thereby establish an electrical connection between the wire and the light emitting device or its socket. A desirable application of the present invention is an electrical lights decorating apparatus having two elongated electrical wires and a multiplicity of small lamps or sockets having the special connector members wired together to the two elongated wires. The two elongated wires can then be affixed onto different objects and configured into various patterns for decoration and other purposes.

18 Claims, 5 Drawing Sheets

FIG. 1
PRIOR ART
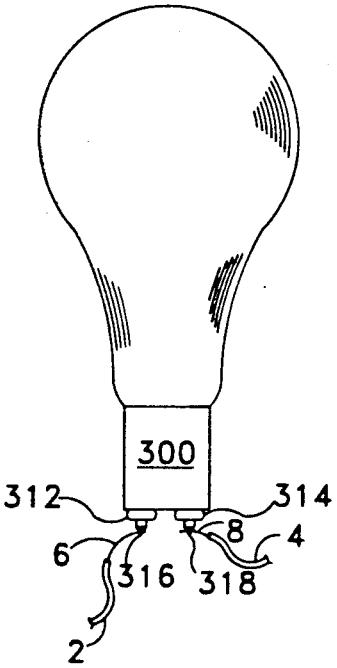
FIG. 2
PRIOR ART
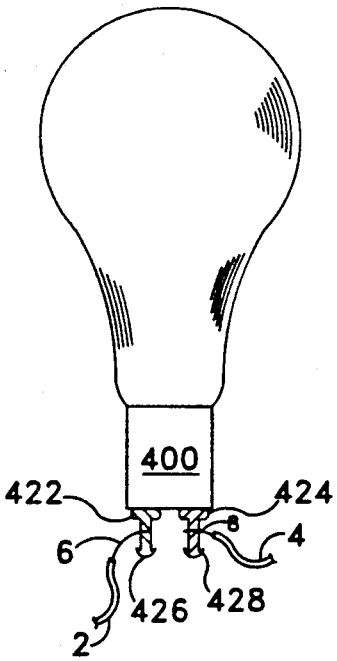
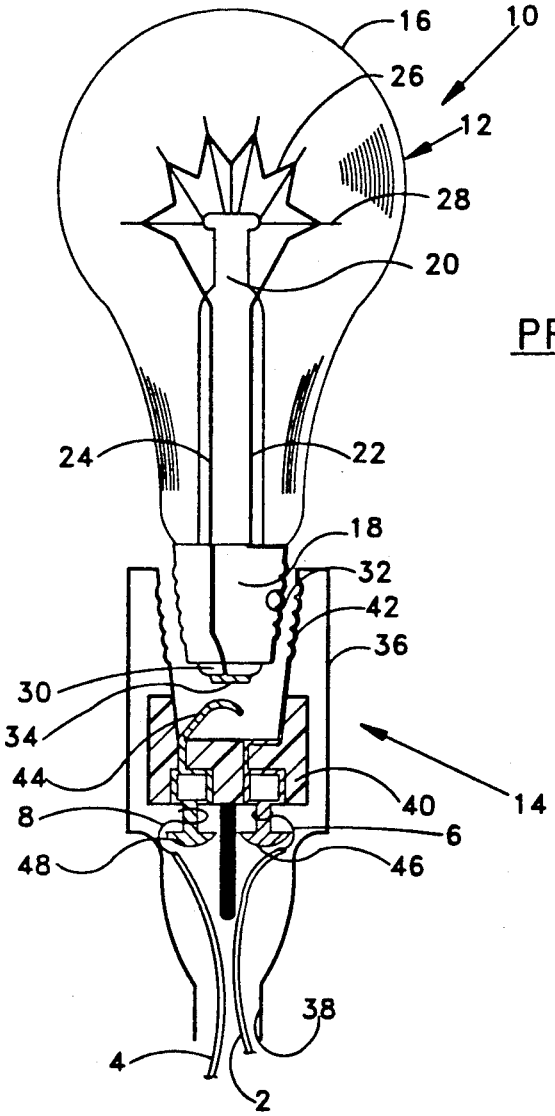
FIG. 3
PRIOR ART
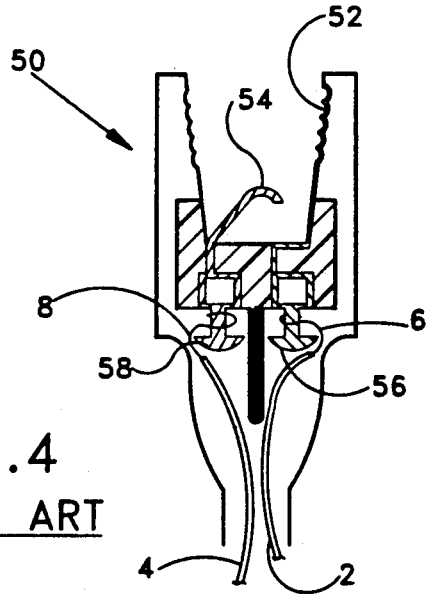
FIG. 4
PRIOR ART FIG.5
PRIOR ART
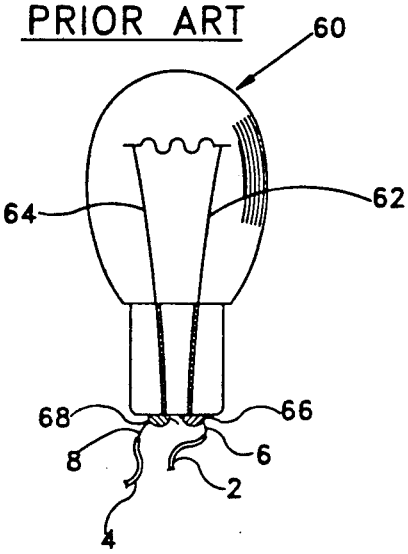
FIG.6
PRIOR ART
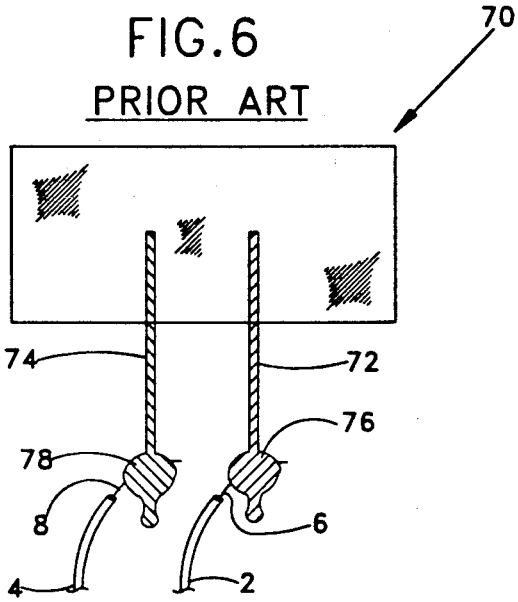
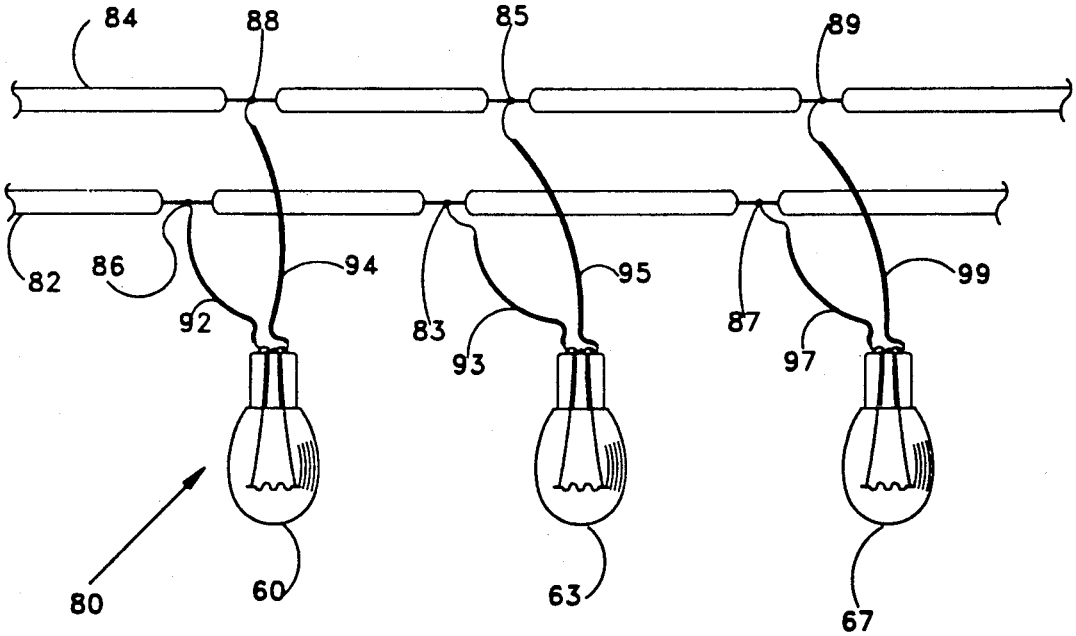
FIG.7
PRIOR ART

SPECIAL CONNECTOR MEMBERS FOR SMALL ELECTRICAL LIGHT EMITTING DEVICES, BASES, AND SOCKETS

BACKGROUND OF THE INVENTION

1. Field of the Invention

The present invention relates to the field of small electrical light emitting devices used in low current electrical circuits. More particularly the present invention relates to the field of small electrical lamps, light bulbs, light emitting diodes (hereafter "LED") and other electrical light emitting devices, their bases and their sockets, having solderless electrical connector members with a self-stripping slit for connection with thin insulated electrical wires.

2. Description of the Prior Art

The following prior art patents have been uncovered which are relevant to the present invention:

1. U.S. Pat. No. 4,806,120 issued to Baker on Feb. 21, 1989 for "Electrical Terminal" (hereafter the "Baker Patent").

2. U.S. Pat. No. 4,722,699 issued to Heng et al. on Feb. 2, 1988 for "Embedded Wire-Stripping Connector For Electrical Equipment" (hereafter the "Heng Patent").

3. U.S. Pat. No. 4,682,835 issued to Aujla et al. on Jul. 28, 1987 for "Insulation Displacing Terminal With Cantilever Spring Contact Members" (hereafter the "Aujla Patent").

4. U.S. Pat. No. 4,291,935 issued to Badoz et al. on Sep. 29, 1981 for "Self-Stripping Contact Element For A Connector" (hereafter the "Badoz Patent").

5. U.S. Pat. No. 3,869,190 issued to Bazille, Jr. on Mar. 4, 1975 for "Solderless Wire Connector" (hereafter the "Bazille Patent").

6. U.S. Pat. No. 3,012,219 issued to Levin et al. on Dec. 5, 1961 for "Solderless Connector For Insulated Small Wires" (hereafter the "Levin Patent").

7. German Patent No. 3,637,929 issued to Krone on Jan. 28, 1988 for "Clamping Terminal Especially For Very Thin Electrical Conductor" (hereafter the "German Patent").

8. European Patent No. 251,736 issued to Seidel on Jan. 7, 1988 for "Wire-Holder With Barbed Sidewalls For Electric Connector" (hereafter the "European Patent").

The Levin Patent discloses a solderless connector 10 for insulated small wires. Connector 10 has a base 11, a cap 22 and a connector member 15. Base 11 has three longitudinal grooves for embedding three small wires in a longitudinal direction. Connector member 15 has two transversal plates 16 and 18 which are parallel to each other. Each plate has three vertical slots positioned according to the locations of the small wires. When connector member 15 is inserted between base 11 and cap 22, the small wires are forced into respective slots of connector member 15. The opposing edges of each slot penetrate the insulating cover 37 of a respective small wire and thus contact the copper core 35 of the small wire. The Levin Patent is used to solderlessly connect a multiplicity of small wires. FIGS. 3 and 4 of the Levin Patent illustrate the concept of the stripping slot for connecting small wires.

The Bazille Patent discloses a solderless wire connector 12. Connector 12 is a doubly folded spring compression reserve connector contact having a pair of spaced planar resilient elements 14 and 15 interconnected by an upper portion 27. Each planar element has multiple slots, where each slot at one planar element is aligned with a respective slot at the other planar element. The Bazille Patent is also used to solderlessly connect multiple wires.

The Badoz Patent discloses a self-stripping contact element for a connector. The connector has an elongated longitudinal body with a split front portion having two elastic parts and a bench-like rear portion 14 having three transversal walls 15, 17 and 19. The first transversal wall 15 has a connecting slot 16 having a narrow opening for stripping the insulation of a wire and thus making a proper electrical connection. The second transversal wall 17 has a first anchoring slot having a wider opening for retaining the wire against the axial stresses. The third transversal wall 19 has a second anchoring slot 30 having a curvilinear portion "C" for retaining the wire against radial stresses.

The Aujla Patent discloses an insulation displacing terminal having a base 10 and two cantilevered spring contact members 11 and 12 for connecting various types of conductors. Each cantilevered spring contact member has a lower portion 15 and an upper portion 24 of different shapes and thickness congruent at a neck section 18. The slots between the two contact members 11 and 12 also have a lower portion and an upper portion separated by neck section 18.

The Heng Patent discloses an embedded wire-stripping connector for electrical equipment. The connector has a rectangular shaped main section having an elongated slot. At least one of the two inner edges of the elongated slot has multiple teeth for retaining wires inserted into the slots. The connector is designed to be used in conjunction with a tool blade 17.

The Baker Patent discloses an electric terminal having a longitudinal body part 4, an insulation clamping part 6, a mating part 8 and a spring part 10. Insulation clamping part 6 has two pairs of transversal wings 18 where each wing 18 is contoured and each pair of wings 18 form a transversal slot, such that each slot has a laterally enlarged portion providing a wire strand retaining nest 23. Parts 4, 6 and 8 may be stamped and formed from a single piece of sheet metal stock. Part 10 is stamped and formed from a separate piece of spring metal stock.

The European Patent discloses a wire holder with barbed sidewalls for an electrical connector. The wire holder has a multiplicity of slots for holding a multiplicity of wires. Both of the inner edges off each single slot have flexible barbs, 35 and 37 respectively, where the barbs extend inward and downward from the sidewall.

The German Patent discloses a clamping terminal having double-layered, fork-shaped clamping arms 2 and 3 and a clamping tongue 4 pivoted on the base of the terminal.

Most of the prior art patents are connectors for connecting multiple wires to a common terminal. Some of the prior art patents are designed to be used under heavy strength. It can be concluded that none of the prior art patents discussed above disclose a self-stripping slit which is an integral part of the base of a small lamp or an electrical socket for providing a quick and easy connection for connecting a large number of small lights to electrical wires for decoration and other purposes.

SUMMARY OF THE PRESENT INVENTION

The present invention is a small electrical light emitting device, such as lamp, light bulb, LED or other electrical socket, having special solderless electrical connector members with a self-stripping slit for connection with thin insulated electrical wires.

It is known that a typical low electrical current small light bulb socket has two terminals. For small light bulb sockets used in the direct current (DC) electrical circuits, one of the terminals is the positive terminal, and the other terminal is the negative terminal. For small light bulb sockets used in alternating current (AC) electrical circuits, one of the terminals is the power terminal, and the other terminal is the ground terminal. In either case, there are two thin insulated electrical wires going into a small light bulb socket and connected to the two terminals respectively. For the small light bulb sockets currently available in today's market, there are two conventional methods of connecting the thin insulated wires to the terminals. One conventional method is soldering. The other conventional method is using metal mounting screws. Both methods require manually stripping off the insulating cover of the end portion of an insulated wire to expose its copper conducting core. In the soldering method, the exposed portion of the copper core of the insulated wire is soldered to one of the terminals of a small light bulb socket. In the method using mounting screws, first the exposed portion of the copper core of the insulated wire is wound around the stem of a copper screw, then the copper screw is fastened to one of the terminals of a small light bulb socket. It can be seen that both of the conventional methods require the use of tools for stripping the insulated cover of the wires and tools for either soldering the wires or fastening the screws. In addition, it is very difficult to connect a large number of small light bulb sockets to two single wires for special purposes such as holiday decoration or to a light board requiring a large number of such light bulbs. One has to use an extra pair of short wires to connect each individual small light bulb socket to the two main wires. To connect the two terminals of an individual light bulb socket to the two main wires, each short wire has to be stripped at both ends, and the two main wires have to be stripped at the location of the individual socket. The first stripped ends of the pair of short wires are connected to the stripped points of the two main wires respectively, and the second stripped ends of the two short wires are connected to the two terminals of the individual lamp socket respectively. The same procedure has to be repeated for connecting each small light bulb socket to the two main wires. The entire process is very complicated and time consuming.

It has been discovered, according to the present invention, that if each terminal of a small light bulb socket is made of a thin metal plate having a narrow slit, where the inner edges of the metal plate which define the narrow slit are very sharp, when an end of a thin insulated electrical wire is inserted into the narrow slit, the sharp inner edges of the metal plate will automatically strip off the insulated cover of the wire at the insertion point and make an electrical connection, without the need of soldering or screw fastening.

It has also been discovered, according to the present invention, that if the terminals of each small light bulb socket are constructed as described above, then the sockets can be directly connected to the two main wires without the use of any extra pair of short wires. Therefore a large number of small light bulb sockets can be very quickly wired together.

It has further been discovered, according to the present invention, that if two small metal plates as described above are mounted to one end of an insulated wire and then to the base of a small light bulb, then the small light bulb can be directly connected to the two main wires without the use of any extra pair of short wires, thus a large number of light bulbs can be very quickly wired together.

It has further been discovered that the present invention can also be incorporated into other electrical light emitting devices such as LEDs.

It is therefore an object of the present invention to provide a small light bulb base which has electrical terminals each made of a thin metal plate having a narrow slit defined by two sharp inner edges of the plate, such that when the end of a thin insulated wire is inserted into the narrow slit, the sharp inner edges of the metal plate will automatically strip off the insulated cover of the wire at the insertion point anywhere along the length of the wire, to make electrical connection without soldering or screw fastening.

It is an additional object of the present invention to provide sockets which have integral terminals as described above so that a large number of these sockets can be very quickly connected together without extra tools.

It is a further object of the present invention to provide small light bulbs having two small metal plates as described above with wires that are directly mounted to their bases or sockets, such that the insulated electrical wires can be an integral connection of the bases or sockets of small light bulbs, so that the small light bulbs can be directly connected to the two main wires without the use of an extra pair of short wires. Therefore a large number of light bulbs can be very quickly wired together.

Further novel features and other objects of the present invention will become apparent from the following detailed description, discussion and the appended claims, taken in conjunction with the drawings.

Other advantages include not ever having to cut the main current carrying wires, strip, and then connecting these ends together again.

BRIEF DESCRIPTION OF THE DRAWINGS

Referring particularly to the drawings for the purpose of illustration only and not limitation, there is illustrated:

FIG. 1 is a perspective view of a prior art small light bulb which requires soldering for electrical wiring.

FIG. 2 is a perspective view of another prior art small light bulb socket which has fastening screws for electrical wiring.

FIG. 3 is a perspective, partially sectioned, view of a prior art small lamp utilizing small fastening screws for electrical wiring.

FIG. 4 is a perspective, partially sectioned, view of a different socket of the prior art small lamp which requires soldering for electrical wiring.

FIG. 5 is a perspective view of a prior art small lamp which requires soldering for electrical wiring.

FIG. 6 is a perspective view of a prior art small LED which requires soldering for electrical wiring.

FIG. 7 is a perspective view showing three prior art small light bulbs connected together, each requiring a respective pair of short wires for electrical wiring.

DETAILED DESCRIPTION OF THE PREFERRED EMBODIMENT

Figure 8:
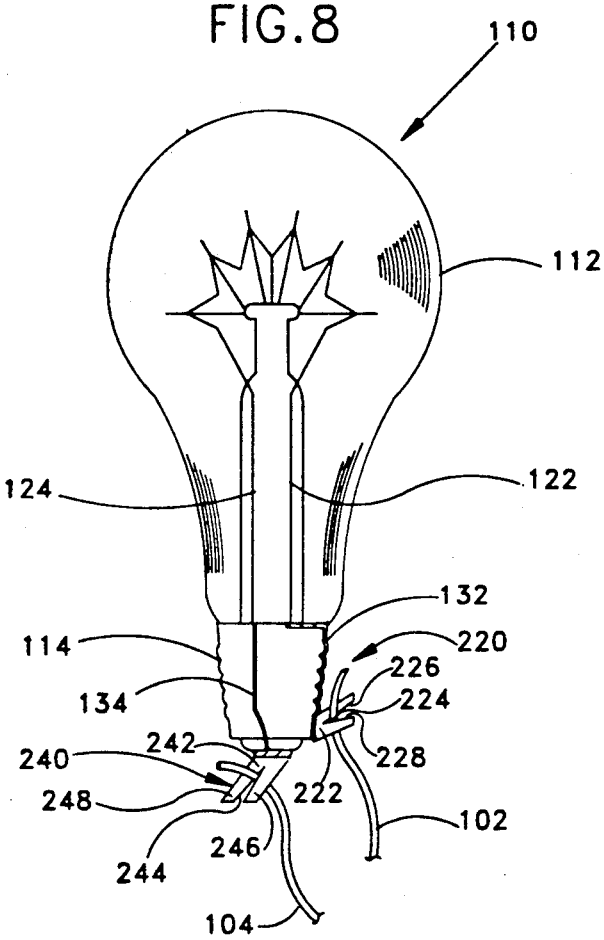
FIG. 8 is a perspective view of one embodiment of the present invention small lamp having special connector members directly mounted to its base.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

A lamp and light bulbs are somewhat synonymous terms. To distinguish them, a light bulb is a lamp with a base. A lamp just has leads coming from the bulb portion.

It has been discussed earlier that a typical low electrical current small light bulb socket has two terminals, which are either the positive terminal and the negative terminal for the DC electrical circuits, or the power terminal and the ground terminal for the AC electrical circuits. Two conventional methods of connecting two thin insulated wires to the terminals respectively are soldering and screw mounting. Both methods require manually stripping off the insulating cover of the end portion of an insulated wire to expose its copper conducting core.

In FIG. 1 there is shown a first type prior art small light bulb socket 300 which requires the conventional soldering method for electrical wiring. Prior art small light bulb socket 300 has two terminals 312 and 314. Two insulated wires 2 and 4 are connected to terminals 312 and 314 of prior art socket 300 respectively by the soldering method. First the end portion of insulated wire 2 is stripped off manually to expose its conducting core 6, and the end portion of insulated wire 4 is also stripped off manually to expose its conducting core 8. Then the exposed conducting core 6 of insulated wire 2 is soldered to terminal 312 of prior art socket 300 by a drop of solder 316 and the exposed conducting core 8 of insulated wire 4 is soldered to terminal 314 of prior art socket 300 by a drop of solder 318. The disadvantage of this first type of prior art small light bulb socket is that at least two kinds of tools are required for such a simple connection: a knife, wire stripper or comparable tool for stripping off the insulated cover at the end of the wires, and a soldering iron for soldering the conducting core of the wires to the terminals.

In FIG. 2 there is shown a second type of prior art small light bulb socket 400 which requires the conventional screw mounting method for electrical wiring. This prior art small light bulb socket 400 also has two terminals 422 and 424 for connection with insulated wires 2 and 4 by mounting screws 426 and 428 respectively. The exposed copper core 6 of insulated wire 2 is wound around the stem of mounting screw 426, and the exposed copper core 8 of insulated wire 4 is wound around the stem of mounting screw 428. By tightening screws 426 and 428, respective exposed conducting cores 6 and 8 of the two wires 2 and 4 are securely mounted to terminals 422 and 424 respectively, and electrical connections are established. The disadvantage of this second type of prior art small light bulb socket is that again at least two kinds of tools are required for such a simple connection: a knife, wire stripper or comparable tool for stripping off the insulating cover at the end of the wires, and a screwdriver for tightening the conducting core of the wires to the terminals.

In FIG. 3 there is shown a prior art small lamp 10 which requires the conventional screw mounting method for electrical wiring. Prior art small lamp 10 has two parts: a light bulb 12 and a socket 14. Light bulb 12 has a glass bulb 16 and a base 18. Inside glass bulb 16 there is a glass mount 20 where power wire 22 and ground wire 24 are mounted. Light emitting filament 26 is connected between the top ends of wires 22 and 24 and supported by support wires 28 which extend from glass mount 20. Adjacent to the bottom of base 18 of light bulb 12 there is an insulating plate. The periphery sidewall 32 of base 18 of light bulb 12 is connected to power wire 22 and has outer screw threads for engagement into socket 14 of light bulb 12. The bottom 34 of base 18 of light bulb 12 is a conducting plate connected to ground wire 24. Sidewall 32 and bottom 34 of base 18 of light bulb 12 are insulated by insulating plate 30. Socket 14 of prior art small lamp 10 has a housing 36 which has a bottom opening 38. Inside socket 14 there is an insulated mount 40. A cylindrical shaped conducting piece 42 is configured with inner screw threads for adapting base 18 of light bulb 12 and engagement with sidewall 32 of base 18. An arcuate shaped conducting piece 44 is designed for engagement to bottom 34 of base 18 of light bulb 12. Conducting pieces 42 and 48 are connected to two screw mounting terminals 46 and 48 respectively. Two insulated electrical wires 2 and 4 are connected to terminals 46 and 48 of prior art lamp 10 respectively by the screw fastening method. First the end portion of insulated wire 2 is stripped off manually to expose its conducting core 6, and the end portion of insulated wire 4 is also stripped off manually to expose its conducting core 8. Then the exposed conducting core 6 of insulated wire 2 is wound around the stem of the mounting screw at terminal 46, and the exposed copper core 8 of insulated wire 4 is wound around the stem of the mounting screw at terminal 48. By tightening the screws, the respective exposed conducting cores 6 and 8 of the two wires 2 and 4 are securely mounted to terminals 46 and 48 respectively, and electrical connections are established. The disadvantage of this first type of prior art small lamp is that at least two kinds of tools are required for such a simple connection: a knife or a wire stripper for stripping off the insulating cover at the end of the wires, and a soldering iron for soldering the conducting core of the wires to the terminals.

In FIG. 4 there is shown a different type of socket 50 for prior art small light bulb 12 which requires the conventional soldering method for electrical wiring. This prior art small light bulb socket 50 also has two conducting pieces 52 and 54 for engaging to sidewall 18 and bottom 34 of base 18 of light bulb 12. Two terminals 56 and 58 are used for connections with insulated wires 2 and 4. The exposed conducting core 6 of insulated wire 2 is soldered to terminal 56 of prior art socket 50 by solder, and the exposed conducting core 8 of insulated wire 4 is soldered to terminal 85 of prior art socket 50 by solder. The disadvantage of this type of prior art small light bulb socket is that again at least two kinds of tools are required for such a simple connection: a knife or a wire stripper for stripping off the insulating cover at the end of the wires, and a soldering iron for soldering the conducting core of the wires to the terminals.

Comparable to the embodiment of FIG. 1, another smaller and simpler type of prior art small lamp 60 is shown in FIG. 5. The power and ground wires 62 and 64 of small light bulb 60 are extended to its base and connected to two terminals 66 and 68 respectively. To make an electrical connection, the exposed conducting core 6 of insulated wire 2 has to be soldered to terminal 66, and the exposed conducting core 8 of insulated wire 4 has to be soldered to terminal 68.

A prior art LED 70 is shown in FIG. 6. The anode 72 and the cathode 74 of prior art LED 70 extends out from its light emitting body. To make an electrical connection, the exposed conducting core 6 of insulated wire 2 has to be soldered to anode 72 by a drop of solder 76, and the exposed conducting core 8 of insulated wire 4 has to be soldered to cathode 74 by another drop of solder 78.

All of the above discussed prior art small light emitting devices require a complicated process of electrical connection. This makes it very difficult to connect a large number of prior art small lamps to two single wires for special purposes such as holiday decoration or for an arrangement on a light display. An example is shown at 80 in FIG. 7 where three prior art small lamps 60, 63 and 67 are wired to two main insulated electrical wires 82 and 84. To connect prior art lamp 60 to the two main wires 82 and 84, an extra pair of short wires 92 and 94 have to be used. First, both ends of short wire 92 have to be stripped, both ends of short wire 94 also have to be stripped, the first main wire 82 has to be stripped at joint 86 and the second main wire 84 has to be stripped at joint 88 where prior art lamp 60 is going to be wired. Then the first stripped end of the first short wire 92 is connected to the first main wire 82 at stripped joint 86, and the first stripped end of the second short wire 94 is connected to the second main wire 84 at stripped joint 88. Finally, the second stripped ends of the first short wire 92 and the second short wire 94 are soldered or screw fastened to the prior art lamp 60. The same procedure has to be repeated for connecting prior art lamp 63 to the two main wires 82 and 84 at joints 83 and 85 with an extra pair of short wires 93 and 95 respectively, and for connecting prior art lamp 67 to the two main wires 82 and 84 at joints 87 and 89 with another extra pair of short wires 97 and 99 respectively. It is clear that the whole process of wiring a large number of prior art small light bulb sockets together is very complicated and time consuming.

Figure 19:
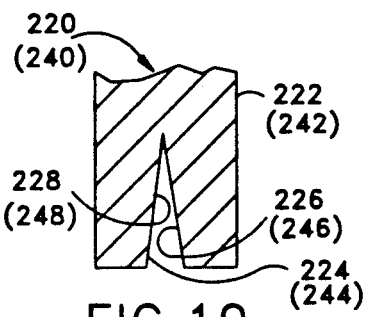
FIG. 19 is a partially detailed view of the special connector members of the present invention.

The present invention small electrical light emitting devices having special connector members which overcome the disadvantages of the prior art small lamps, light bulbs, LEDs and other light emitting devices by incorporating a special connector member into the terminals of a small light bulb socket or to the light bulb, LED, etc. Referring to FIG. 8, there is shown at 110, one of the preferred embodiments of the present invention small lamp having special connector members 220 and 240. The present invention small lamp may have only the light bulb part and eliminate the socket part. Similar to light bulb 12 of the prior art lamp 10, the present invention light bulb 110 has glass bulb 112 and a base 114. Two wires 122 and 124 are connected to the conducting sidewall 132 and conducting bottom 134 of base 114 respectively. The unique feature of the present invention lamp 110 is that it has a first special connector member 220 incorporated onto conducting sidewall 132 of base 114 and serves as the first terminal, and a second special connector member 240 incorporated onto conducting bottom 134 of base 114 and serves as the second terminal. Shown in FIG. 8, and also shown in detail in FIG. 19, first connector member 220 is a small thin conducting plate 222 preferably made of copper, and is generally rectangular shaped and has a very narrow central slit 224 defined by two inner edges 226 and 228 of thin plate 222. Similar to first connector member 220, second connector member 240 of FIG. 8 is also a small thin conducting plate 242 preferably made of copper, and is also generally rectangular shaped and has a very narrow central slit 244 defined by two sharp inner edges 246 and 248 of the thin plate. To connect two thin insulated electrical wires 102 and 104 to the present invention small lamp 110, one simply presses the end of insulated wire 102 into narrow slit 224 of the first connector member 220, and the end of insulated wire 104 into narrow slit 244 of the second connector member 240. When the end of insulated wire 102 is inserted into narrow slit 224 of connector member 220, the two sharp inner edges 226 and 228 of thin plate 222 will automatically cut through the insulated cover of wire 102 immediately adjacent to slit 224 and contact the inner conducting core of wire 102. Moreover, the end of wire 102 will stay in slit 224 because the insulated cover of wire 102 is resilient. Similarly, when the end of insulated wire 104 is inserted into narrow slit 244 of connector member 240, the two sharp inner edges 246 and 248 of thin plate 242 will automatically cut through the insulated cover of wire 104 immediately adjacent to slit 244 and contact the inner conducting core of wire 104, and the end of wire 104 will stay in slit 244 because the insulated cover of wire 104 is also resilient. Compared to the prior art small lamps, the present invention small lamp 110 has significant advantages. For example, it does not have any loose parts such as screws that can be easily lost and, more importantly, it does not require solder or extra tools for wiring.

Figure 20:
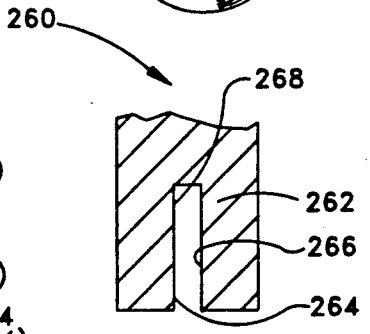
FIG. 20 is a partially detailed view of an alternative embodiment of the special connector members of the present invention.
Figure 21:
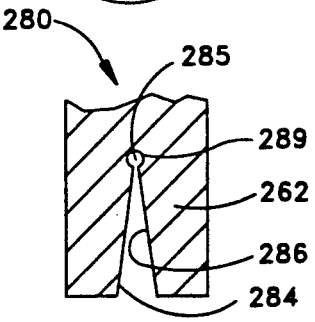
FIG. 21 is a partially detailed view of another embodiment of the special connector members of the present invention.

The present invention special connector member may have other alternative configurations such as a connector extension used for connecting a plurality of wires. The thickness of the small conducting plate, and the width and the depth of the thin slit may all vary to accommodate different types of small insulated wires. As an example, an alternative embodiment of the present invention special connector member is shown at 260 in FIG. 20. The thin slit 264 is defined by the two inner edges 266 and 268 of conducting plate 262. Unlike the "V"-shaped configuration of special connector member 220 shown in FIG. 19, the two inner edges 266 and 268 here are parallel to each other. Another embodiment of the present invention special connector member is shown in FIG. 21 at 280, wherein the two inner edges 286 and 288 of conducting plate 282 also define a "V"-shaped slit 284, but there is a widened opening 285 in the bottom of slit 284 for snugly adapting small wires without accidentally yanking too hard, thereby cutting the wire completely.

Figure 9:
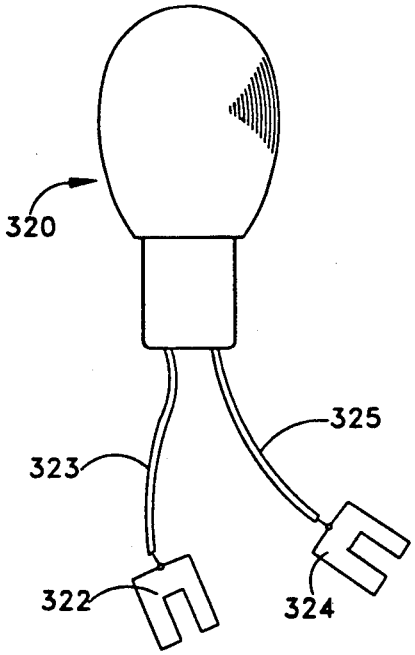
FIG. 9 is a perspective view diagram of an alternative embodiment of the present invention small light bulb socket having special connector members.
Figure 10:
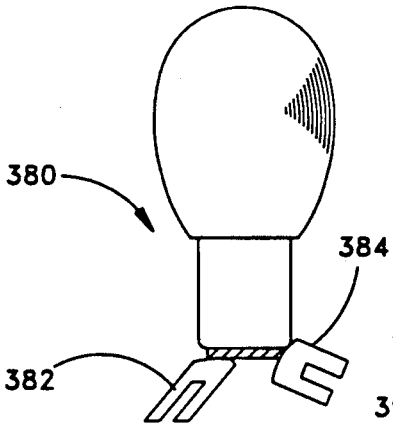
FIG. 10 is a perspective view diagram of another embodiment of the present invention small light bulb socket having special connector members.
Figure 11:
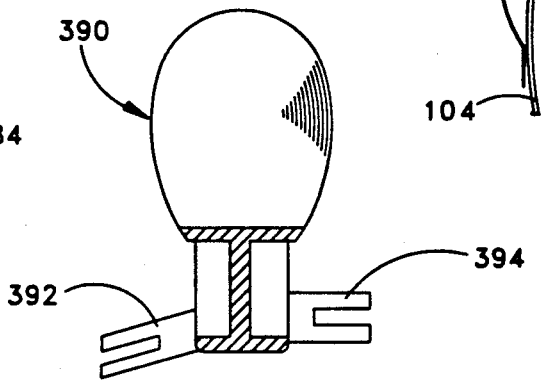
FIG. 11 is a perspective view diagram of still another embodiment of the present invention small light bulb socket having special connector members.

In FIGS. 9-11 there are shown at 320, 380 and 390, some of the alternative embodiments of the present invention small light bulb sockets having special connector members. Referring to FIG. 9, in one alternative embodiment of the present invention small light bulb socket 320 there are two short flexible wires 323 and 325 extending from the bottom of the socket, and two special connector members 322 and 324 attached to the end of short wires 323 and 325 respectively. Referring to FIG. 10, in another alternative embodiment of the present invention small light bulb socket 380, the first special connector member 382 is attached to the bottom of the socket, and the second special connector member 384 is attached to the sidewall of the socket. Further referring to FIG. 11, in still another alternative embodiment of the present invention small light bulb socket 390, the first special connector member 392 is attached to the left half of the sidewall of the socket, and the second special connector member 394 is attached to the right half of the sidewall of the socket.

Figure 12:
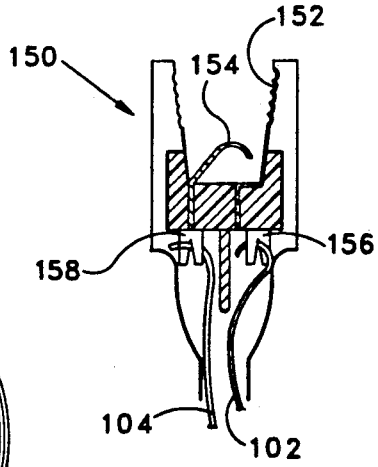
FIG. 12 is a perspective, partially sectioned, view of the socket of the present invention small lamp having special connector members.

The present invention special connector members may also be incorporated into a small light bulb socket, as shown in FIG. 12 at 150. The present invention small light bulb socket 150 has two conducting pieces 152 and 154 for engagement to the sidewall and bottom of the base of a conventional light bulb currently available on the market. Two special connector members 156 and 158 are incorporated into small light bulb socket 150 and connected to conducting pieces 152 and 154 respectively, and serve as the power and ground terminals for connections with insulated wires 102 and 104. The advantage of this embodiment is that it enables quick and easy electrical wiring as described above without any additional tools, yet still can be used with conventional light bulbs currently available on the market.

Figure 13:
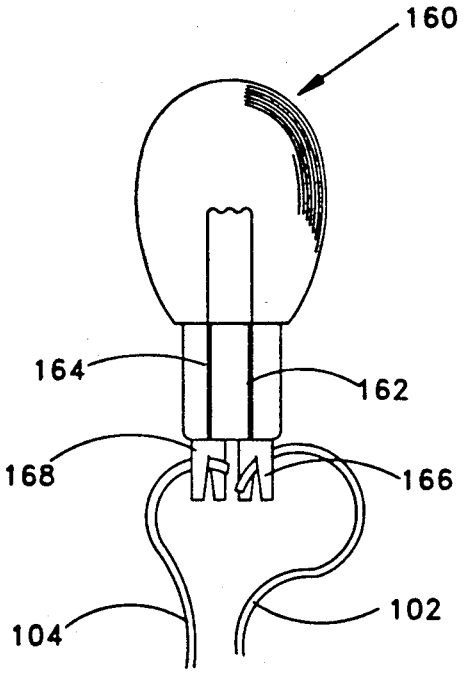
FIG. 13 is a perspective view of the present invention small light bulb having special connector members directly mounted to its base.

Another embodiment of the present invention for smaller and simpler light bulbs is shown in FIG. 13 at 160. Again, the power and ground wires 162 and 164 of small light bulb 160 are extended to its base. Two special connector members 166 and 168 are directly attached onto small light bulb 160 and connected to wires 162 and 164 respectively, and serve as the power and ground terminals for connections with insulated wires 102 and 104.

Figure 14:
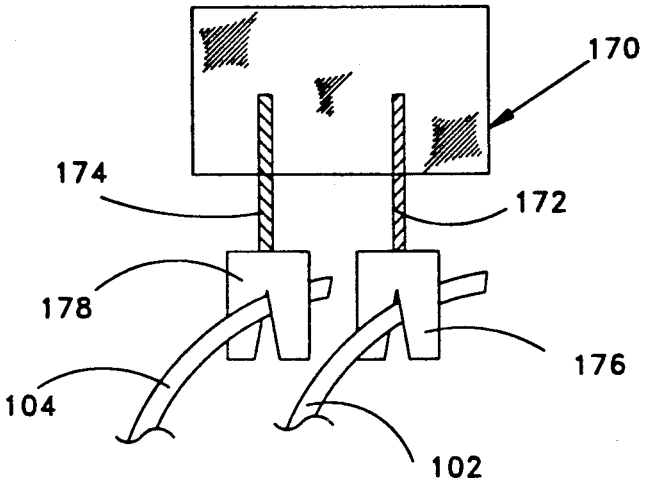
FIG. 14 is a perspective view of a present invention small LED having special connector members directly mounted to its anode and cathode.

The embodiment of the present invention for an LED is shown in FIG. 14 at 170. The anode 172 and the cathode 174 of LED 170 extend out from its light emitting body. Two special connector members 176 and 178 are directly attached onto anode 172 and cathode 174 of LED 170 respectively, and serve as the two terminals for connections with insulated wires 102 and 104.

Figure 15:
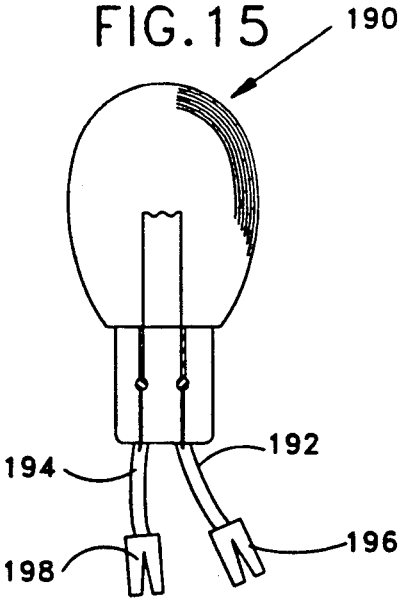
FIG. 15 is a perspective view of another embodiment of the present invention small light bulb having special connector members connected to a pair of flexible wires extending from the base of the small light bulb.

An alternative embodiment of the present invention for smaller and simpler light bulbs is shown in FIG. 15 at 190. The power and ground wires of small light bulb 190 are connected to two small flexible short wires respectively which in turn extend out from the base of small light bulb 190. Two special connector members 196 and 198 are attached to the respective ends of the two short wires 192 and 194, and serve as the two terminals of small light bulb 190.

Figure 16:
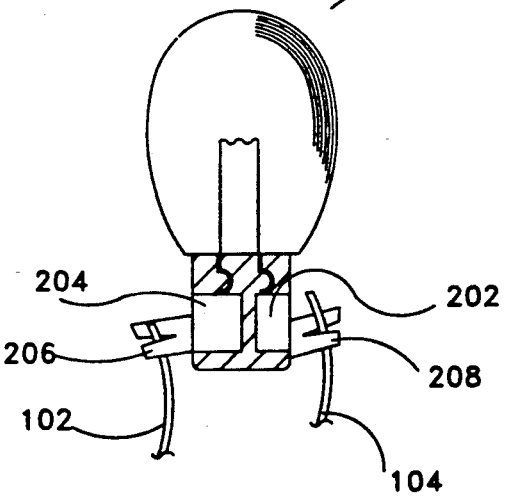
FIG. 16 is a perspective view of an alternative embodiment of the present invention small light bulb having special connector members directly mounted to its base.

Another alternative embodiment of the present invention for smaller and simpler light bulbs is shown in FIG. 16 at 200. The power and ground wires of small light bulb 200 extend respectively to the right half 202 and the left half 204 of the sidewall of its base which are insulated from each other. Two special connector members 206 and 208 are directly attached onto left half 202 and right half 204 of the sidewall of the base respectively, and serve as the two terminals for connections with insulated wires 102 and 104. This embodiment is designed to suit those so constructed small light bulbs wherein the two light emitting wires are connected to the sidewall of the base, rather than to the bottom.

Unlike prior art small light bulb sockets, it is very quick and easy to connect a large number of the present invention small light bulb sockets to two single wires. An example shown at 180 in FIG. 17 where three present invention small lamps 160, 163 and 165 are wired to two main insulated electrical wires 182 and 184. To connect present invention socket 160 to the two main wires 182 and 184, it is no longer necessary to use the extra short wire such as that used for prior art sockets, nor is it necessary to cut or strip main wires 182 and 184. Instead, the connection is simply made by inserting a very short portion of main wire 182 into the narrow slit 234 of the first connector member 166 of the present invention small lamp 160, and a very short portion of main wire 184 into the narrow slit 254 of the second connector member 168 of the present invention small lamp 160. The two sharp inner edges 236 and 238 of the first connector member 166 of the present invention small lamp !60 will automatically strip off the insulated cover of main wire 182 at the point immediately adjacent to the slit 234 of the first connector member 166 and thus establish proper electrical connection, and the two sharp inner edges 256 and 258 of the second connector member 168 of the present invention small lamp 160 will automatically strip off the insulated cover of main wire 184 at the point immediately adjacent to the slit 254 of the second connector member 168 and thus again establish electrical connection. The resilience of the insulated covers of main wires 182 and 184 will help keep the present invention small lamp 160 attached to the two main wires 182 and 184. The same simple procedure is repeated for connecting the present invention sockets of small lamps 163 and 165 to the two main wires 182 and 184. Clearly, the whole process of wiring a large number of the present invention small light bulb sockets together is now neither complicated nor time consuming.

Figure 17:
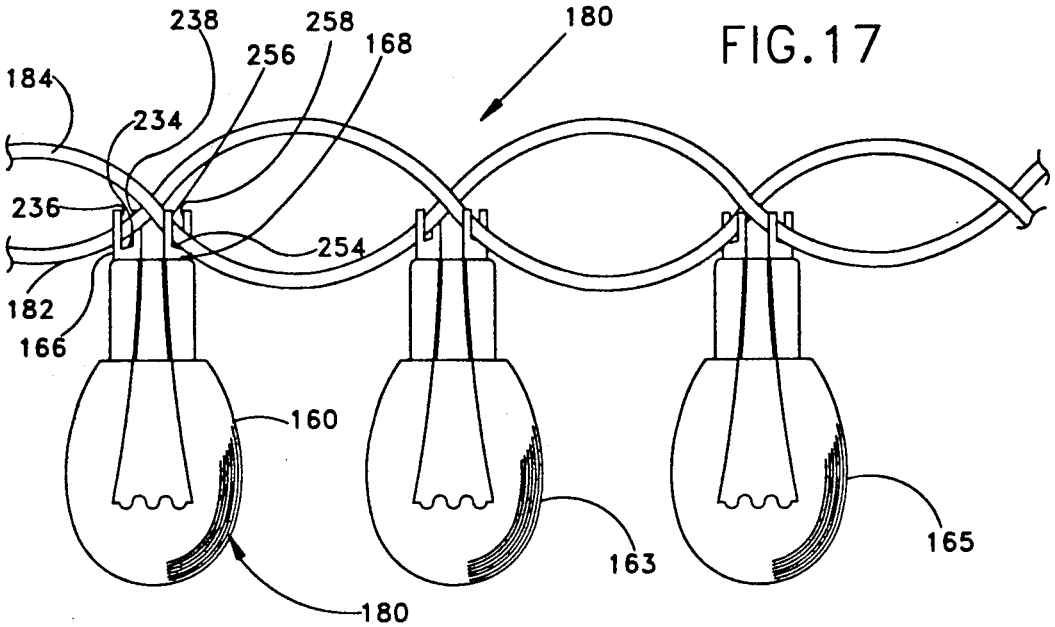
FIG. 17 is a perspective view showing three present invention small light bulbs connected together without the need of extra short wires.
Figure 18:
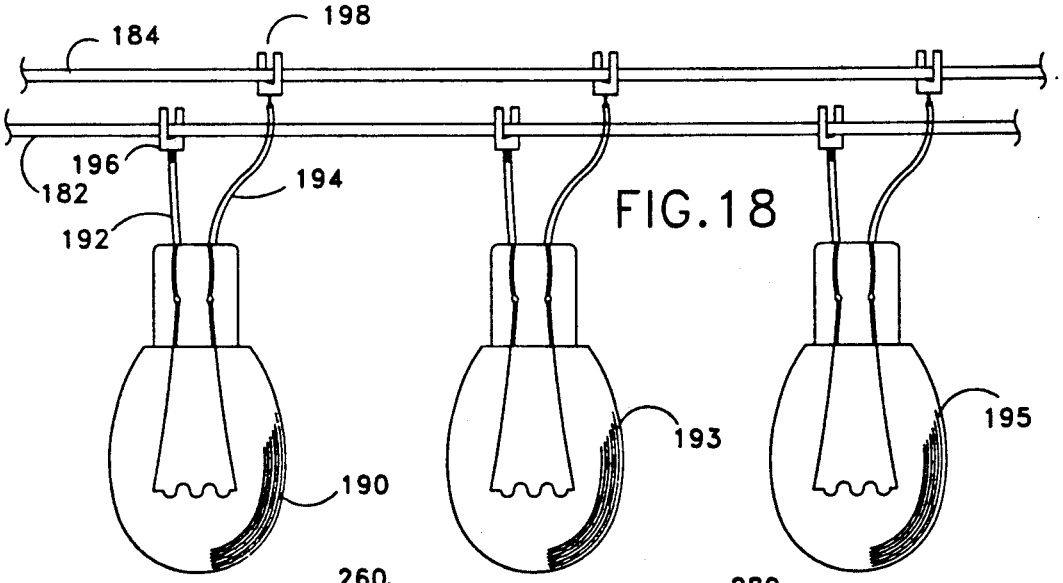
FIG. 18 is a perspective view showing three small light bulbs of the alternative embodiment of the present invention connected together without the need of extra short wires.

Similar to FIG. 17, there is shown in FIG. 18 three small lamps of the alternative embodiment of the present invention wired together to two main electrical wires 182 and 184. Small lamps 190, 193 and 195 are the same as the embodiment 190 shown in FIG. 15, where the two electrical connector members are respectively attached to two flexible short wires extended to the bottom of the light bulb.

The present invention is particularly useful when a large number of small light emitting devices need to be wired together for decoration or other purposes. For example, the two main wires may be affixed to a board, a window or other objects, and formed into various patterns, figures or symbols. Then hundreds of present invention small light bulb sockets or light bulbs, or LEDs, or other light emitting devices can be very quickly wired to the two main wires in the ways as shown in FIGS. 17 and 18.

Defined in detail, the present invention is a small electrical lamp or socket comprising two electrical connector members each made of a generally rectangular shaped small and thin conducting plate having a narrow slit defined by two sharp inner edges of the plate, whereby when a portion of an electrical wire having a conducting core and insulating cover is inserted into the narrow slit, the two sharp inner edges of the conducting plate will automatically strip off the insulating cover of the wire immediately adjacent to the slit and thus contact the conducting core of the wire to thereby establish electrical connection between the wire and the small lamp or socket.

In the preferred embodiments of the present invention defined in detail, the small and thin conducting plate of each electrical connector member is made of copper or aluminum. The base portion of the small lamp is generally cylindrical with a bottom and a sidewall. In one preferred embodiment of the present invention, the two electrical connector members are attached to the bottom of the base portion of the small lamp or socket. In other alternative embodiments of the present invention, the two electrical connector members are attached to the sidewall of the base portion of the small lamp or socket, or one is attached to the bottom of the base portion of the small lamp or socket and the other one is attached to the sidewall of the base portion of the small lamp or socket. Furthermore, the two electrical connector members may be attached to two short electrical wires extended from the base portion of the small lamp or socket.

Defined alternatively in detail, the present invention is a small electrical light bulb socket comprising two electrical connector members each made of a generally rectangular shaped small and thin conducting plate having a narrow slit defined by two sharp inner edges of the plate, whereby when a portion of an electrical wire having a conducting core and insulating cover is inserted into the narrow slit, the two sharp inner edges of the conducting plate will automatically strip off the insulating cover of the wire immediately adjacent to the slit and thus contact the conducting core of the wire to thereby establish electrical connection between the wire and the small light bulb socket.

Defined also alternatively in detail, the present invention is a small electrical light emitting diode comprising two electrical connector members respectively attached to its anode and cathode, each connector member being made of a generally rectangular shaped small and thin conducting plate having a narrow slit defined by two sharp inner edges of the plate, whereby when a portion of an electrical wire having a conducting core and insulating cover is inserted into the narrow slit, the two sharp inner edges of the conducting plate will automatically strip off the insulating cover of the wire immediately adjacent to the slit and thus contact the conducting core of the wire to thereby establish electrical connection between the wire and the small light emitting diode.

Defined broadly, the present invention is for an electrical light decorating apparatus comprising: (a) a first and a second elongated electrical wires each having a conducting core and insulating cover; (b) a multiplicity of small electrical lamps, each having a first connector member and a second connector member, each connector member made of a thin conducting plate having a narrow slit defined by two inner edges of the plate; and (c) said multiplicity of small lamps wired together to said first and second elongated wires, where each individual small lamp is connected to said first wire by having a respective portion of said first wire inserted into the narrow slit of said first connector member of the individual small lamp, so that the two inner edges of the conducting plate automatically strip off the insulating cover of said first wire immediately adjacent to the slit and thus contact the conducting core of said first wire to thereby establish electrical connection between said first wire and the individual small lamp, and each individual small lamp is connected to said second wire by having a respective portion of said second wire inserted into the narrow slit of said second connector member of the individual small lamp, so that the two inner edges of the conducting plate automatically strip off the insulating cover of said second wire immediately adjacent to the slit and thus contact the conducting core of said second wire to thereby establish electrical connection between said second wire and the individual small lamp; (d) whereby said first and second wires can be affixed onto different sized objects and configured into various patterns for decoration and other functional purposes easily.

Defined more broadly, the present invention is a small light emitting device comprised of electrical connector members made of a thin conducting plate having a narrow slit defined by two inner edges of the plate, whereby when a portion of an electrical wire having a conducting core and insulating cover is inserted into the narrow slit, the two inner edges of the conducting plate will automatically strip off the insulating cover of the wire immediately adjacent to the slit and thus contact the conducting core of the wire to thereby establish electrical connection between the wire and the light emitting device or the socket to which the conducting plates are attached.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A small electrical lamp comprising a bulb portion housing an electrical light emitting member having two opposite electrical terminals, a base portion housing said two opposite electrical terminals of said electrical light emitting member, and two electrical connector members each made of a small and thin conducting plate having a narrow slit defined by two sharp inner edges of said plate, where said two electrical connector members are respectively connected to said two opposite electrical terminals of said electrical light emitting member and externally exposed outside said base portion, said two electrical connector members nondetachably and rigidly bound with and become fixed integral parts of said base portion, whereby when a portion of an electrical wire having a hard conducting core and a resilient insulating cover is inserted into said narrow slit, said two sharp inner edges of said conducting plate will automatically strip off said resilient insulating cover of said electrical wire immediately adjacent to said slit and thus contact said hard conducting core of said electrical wire to thereby establish electrical connection between said electrical wire and said small electrical lamp, and the elasticity of said resilient insulating cover of said electrical wire acts to keep said small electrical lamp on said electrical wire.

2. The invention as defined in claim 1 wherein said small and thin conducting plate of each electrical connector member is made of copper.

3. The invention as defined in claim 1 wherein said small and thin conducting plate of each electrical connector member is made of aluminum.

4. The invention as defined in claim 1 wherein said base portion of said small electrical lamp is generally cylindrical shaped with a bottom and a sidewall.

5. The invention as defined in claim 4 wherein said two electrical connector members are nondetachably formed with said bottom of said generally cylindrical shaped base portion of said small electrical lamp.

6. The invention as defined in claim 4 wherein said two electrical connector members are nondetachably formed with said sidewall of said generally cylindrical shaped base portion of said small electrical lamp.

7. The invention as defined in claim 4 wherein one of said two electrical connector members is nondetachably formed with said bottom of said generally cylindrical shaped base portion of said small electrical lamp and the other one of said two electrical connector members is nondetachably formed with said sidewall of said generally cylindrical shaped base portion of said small electrical lamp.

8. A small electrical light bulb comprising an envelope base housing two opposite electrical terminals, and two electrical connector members each made of a small and thin conducting plate having a narrow slit defined by two sharp inner edges of the plate, where said two electrical connector members are respectively connected to said two opposite electrical terminals and nondetachably and rigidly bound with and become fixed integral parts of said envelope base, whereby when a portion of an electrical wire having a hard conducting core and a resilient insulating cover is inserted into said narrow slit, said two sharp inner edges of said conducting plate will automatically strip off said resilient insulating cover of said electrical wire immediately adjacent to said slit and thus contact said hard conducting core of said electrical wire to thereby establish electrical connection between said electrical wire and said small electrical light bulb, and the elasticity of said resilient insulating cover of said electrical wire acts to keep said small electrical light bulb on said electrical wire.

9. The invention as defined in claim 8 wherein said small and thin conducting plate of each electrical connector member is made of copper.

10. The invention as defined in claim 8 wherein said small and thin conducting plate of each electrical connector member is made of aluminum.

11. A small electrical light emitting diode comprising an electrical light emitting member having an anode and a cathode, and two electrical connector members each made of a small and thin conducting plate having a narrow slit defined by two sharp inner edges of the plate, where said two electrical connector members are respectively connected to and nondetachably and rigidly bound with and become fixed integral parts of said anode and cathode of said electrical light emitting member respectively, whereby when a portion of an electrical wire having a hard conducting core and a resilient insulating cover is inserted into said narrow slit, said two sharp inner edges of said conducting plate will automatically strip off said resilient insulating cover of said electrical wire immediately adjacent to said slit and thus contact said hard conducting core of said electrical wire to thereby establish electrical connection between said electrical wire and said small light emitting diode, and the elasticity of said resilient insulating cover of said electrical wire acts to keep said small electrical light emitting diode on said electrical wire.

12. The invention as defined in claim 11 wherein said small and thin conducting plate of each electrical connector member is made of copper.

13. The invention as defined in claim 11 wherein said small and thin conducting plate of each electrical connector member is made of aluminum.

14. An electrical lights decorating apparatus comprising:

a. a first elongated electrical wire and a second elongated electrical wire, each having a hard conducting core and a resilient insulating cover;

b. a multiplicity of small electrical lamps each having a bulb portion housing an electrical light emitting member having two opposite electrical terminals, a base portion housing said two opposite electrical terminals of said electrical light emitting member, and a first electrical connector member and a second electrical connector member, each made of a thin conducting plate having a narrow slit defined by two inner edges of said plate, where said first and second electrical connector members are respectively connected to said two opposite electrical terminals of said electrical light emitting member and externally exposed outside said base portion of each said small electrical lamp, said first and second electrical connector members nondetachably and rigidly bound with and become fixed integral parts of said base portion;

c. said multiplicity of small electrical lamps wired together to said first and second elongated electrical wires, where each individual small lamp is connected to said first elongated electrical wire by having a respective portion of said first elongated electrical wire inserted into said narrow slit of said first electrical connector member of said individual small lamp, so that said two inner edges of said conducting plate automatically strip off said resilient insulating cover of said first elongated electrical wire immediately adjacent to said slit and thus contact said hard conducting core of said first elongated electrical wire to thereby establish electrical connection between said first elongated electrical wire and said individual small electrical lamp, and said individual small electrical lamp is also connected to said second elongated electrical wire by having a respective portion of said second elongated electrical wire inserted into said narrow slit of said second electrical connector member of said individual small lamp, so that said two inner edges of said conducting plate automatically strip off said resilient insulating cover of said second elongated electrical wire immediately adjacent to said slit and thus contact said hard conducting core of said second elongated electrical wire to thereby establish electrical connection between said second elongated electrical wire and said individual small lamp; and d. where the elasticity of said resilient insulating covers of said first and second elongated electrical wires act to keep said multiplicity of small lamps on said first and second elongated electrical wires;

e. whereby said first and second elongated electrical wires can be affixed onto different objects and configured into various patterns for decoration and other purposes.

15. The invention as defined in claim 14 wherein said thin conducting plates of said first and second electrical connector members of said multiplicity of small electrical lamps are made of copper.

16. The invention as defined in claim 14 wherein said thin conducting plates of the first and second electrical connector members of said multiplicity of small electrical lamps are made of aluminum.

17. The invention as defined in claim 14 wherein said base portion of each small electrical lamp is generally cylindrical shaped with a bottom and a sidewall.

18. The invention as defined in claim 17 wherein said first and second electrical connector members of each small electrical lamp are nondetachably formed with said bottom of said generally cylindrical shaped base portion of said small electrical lamp.

* * * * *